US006113419A

United States Patent [19]

Finley et al.

[11] Patent Number: 6,113,419

[45] Date of Patent: Sep. 5, 2000

[54] UNIT WITH WIRE TERMINATION AND RJ STYLE PLUG

[75] Inventors: Jason A. Finley, Highlands Ranch; Peter J. Lotinsky, Denver, both of Colo.

[73] Assignee: KRONE GmbH, Berlin-Zehlendorf, Germany

[21] Appl. No.: 09/323,567

[22] Filed: Jun. 1, 1999

[51] Int. Cl.[7] ..... H01R 4/24

[52] U.S. Cl. ..... 439/418; 439/936; 439/409; 439/521; 439/344

[58] Field of Search ..... 439/418, 676, 439/409, 344, 369, 371, 373, 271, 519, 520, 521, 936

[56] References Cited

U.S. PATENT DOCUMENTS

| | | | |
|---|---|---|---|
| 1,979,756 | 11/1934 | McNamee et al. | 439/371 |
| 2,913,791 | 11/1959 | Martin | 439/369 |
| 5,562,491 | 10/1996 | Shimirak et al. | 439/521 |
| 5,632,639 | 5/1997 | Hayashi | 439/271 |
| 5,732,445 | 3/1998 | Stodolka et al. | 439/369 |
| 5,934,934 | 8/1999 | Ward | 439/521 |
| 5,947,761 | 9/1999 | Pepe | 439/409 |
| 5,957,720 | 9/1999 | Boudin | 439/676 |
| 5,975,936 | 11/1999 | Lin et al. | 439/676 |

*Primary Examiner*—Gary F. Paumen
*Assistant Examiner*—Tho D. Ta
*Attorney, Agent, or Firm*—Mcglew and Tuttle, P.C.

[57] ABSTRACT

An RJ style plug is provided including a plug body and a contact supported by the body. The contact includes a plug portion with a plug contact surface and an insulation displacement contact portion with a wire receiving contact slot. The device may also include an attaching body. The plug body may include connection surfaces for connecting the attaching body to the plug body. The attaching body has a wire positioning surface for positioning a wire in the contact slot and attaching the attaching body to the plug body via the connection surfaces. The wire positioning surfaces may include surfaces defining a bore for receiving a wire end and an opening extending from a plug side surface of the attaching body to the bore, the opening being sized to receive an end of the insulation displacement contact portion when the attaching body is connected to the plug body. The connection surfaces may include a pivot surface associated with one of the attaching body and the plug body and a pivot receiving surface associated with the other of the attaching body and the plug body. The connection surfaces may include a snap element associated with one of the attaching body and the plug body and a snap receiving surface associated with the other of the attaching body and the plug body.

20 Claims, 15 Drawing Sheets

UNIT WITH WIRE TERMINATION AND RJ STYLE PLUG

FIELD OF THE INVENTION

The invention relates generally to RJ style plugs or other similar communication application connectors and more particularly to an RJ style plug with an incorporated insulation displacement contact or cutting/clamping contact, which facilitates terminating wires to the plug conductors.

BACKGROUND OF THE INVENTION

Connections and connectors for communication applications often include plug and socket connections. Different media are often associated with particular types of plugs and sockets. Although many applications are provided with wires terminated directly to termination blocks, for example including insulation displacement contacts (IDC's), it is advantageous to use plugs and sockets, particularly where rearrangement and testing of the connections is necessary.

Particularly in United States, for communications applications, RJ style plugs and sockets (jacks) are used. The plugs (e.g., RJ11 and RJ45) are modular units with contacts disposed in a contact region or over a contact face. Different formats are used for connecting the wires to the plug module. Most of the arrangements require tools or crimping devices for making an adequate connection.

The modular plugs typically used do not always provide adequate connections, for example for high frequency applications. The tools used in the arrangements that are typically provided require a great deal of labor. The quality of the connection can vary based on the integrity of the connection provided by the plug.

SUMMARY AND OBJECTS OF THE INVENTION

It is an object of the invention to provide a plug with a contact region as well as conductors which include a plug contact portion with contact surfaces disposed at the plug contact region and which also include an IDC portion with an IDC.

It is still another object of the invention to provide a plug assembly which allows a convenient and preferably a toolless termination of wires via insulation displacement contacts.

Still another object of the invention to provide an RJ style plug and a connected conductor which is an integral element including a plug contact face and an insulation displacement contact. Preferably, a plurality of conductors are provided (e.g., from 2 to 8). An additional cover part is provided which is connected to the plug and which facilitates termination of wires to the IDC's and with the plug defines an enclosure for the wire/IDC connection. Each IDC contact can terminate multiple conductors (e.g. wires) per RJ contact.

Still a further object of the invention is to provide a plug body, a connected plug contact/IDC structure and a cover including openings for receiving wires wherein the cover connects to the plug body for termination of the wires disposed in the openings.

According to the invention, an RJ style plug is provided including a plug body and a contact supported by the body. The contact includes a plug portion with a plug contact surface and an insulation displacement contact portion with a wire receiving contact slot.

The device may include an attaching body (or cover). The plug body may include connection surfaces for connecting the attaching body to the plug body. The attaching body has a wire positioning surface for positioning a wire in the contact slot and attaching the attaching body to the plug body via the connection surfaces. The wire positioning surfaces may include surfaces defining a bore for receiving a wire end and an opening or slot extending from a plug side surface of the attaching body to the bore. The opening is sized to receive an end of the insulation displacement contact portion when the attaching body is connected to the plug body. One or both of the bore and slot/opening may be filled with a gel material. This facilitates providing a sealed connection. The connection surfaces may include a pivot surface associated with one of the attaching body and the plug body and a pivot receiving surface associated with the other of the attaching body and the plug body. The connection surfaces may include a snap element associated with one of the attaching body and the plug body and a snap receiving surface associated with the other of the attaching body and the plug body.

The attaching body and the plug body may be shaped to cooperate to define a gel sealing space with a gel substance therein. The plug may also incorporate a gasket to seal against the plug socket. The gasket may be provided around the plug profile part.

The plug body may have a latch element associated with a plug end of the plug body and a latch activating element (latch actuator)connected to the plug body. This allows for actuation of the latch wherein a rear body is provided associated with the plug body that limits access to the latch region of the plug body. Also, the latch actuator allows a complete seal to be formed around the jack opening (and around the periphery of the profile part).

A plurality of the contacts may be provided within each plug body with each having a plug contact portion with a contact surface and an IDC portion with a wire receiving slot. The number is preferably between two and eight contacts (i.e., the minimum and maximum number of contacts typically used with an RJ style jack, corresponding to from one to 4 transmission lines).

The plug body is preferably a plastic molded part (e.g. an injection molded part). The contact may be made of a single integral metal piece including one end with the IDC portion and an opposite end with the plug contact portion. The attaching piece or cover is preferably a plastic molded part.

The plug portion supports the contact with the insulation displacement contact portion being preferably at an angle with respect to the wire to be connected. The plug part and the attaching part preferably cooperate to position a wire extending in a wire direction. The plug part supports the contact with the insulation displacement slot formed by contact parts extending at an angle with respect to the wire direction. The angle may be advantageously about 45°.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
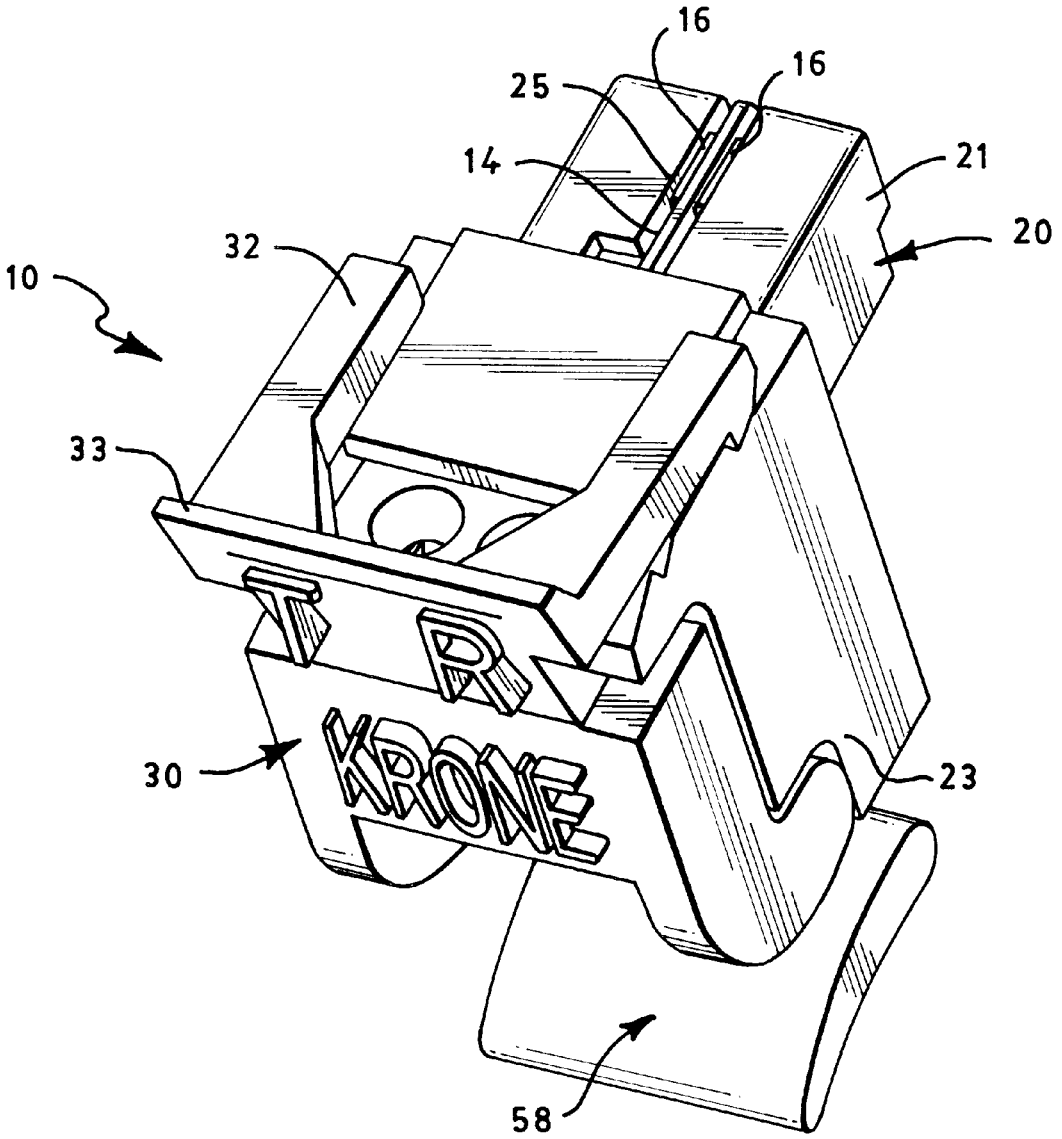
FIG. 1 is a top right front perspective view of an embodiment according to the invention.
Figure 2:
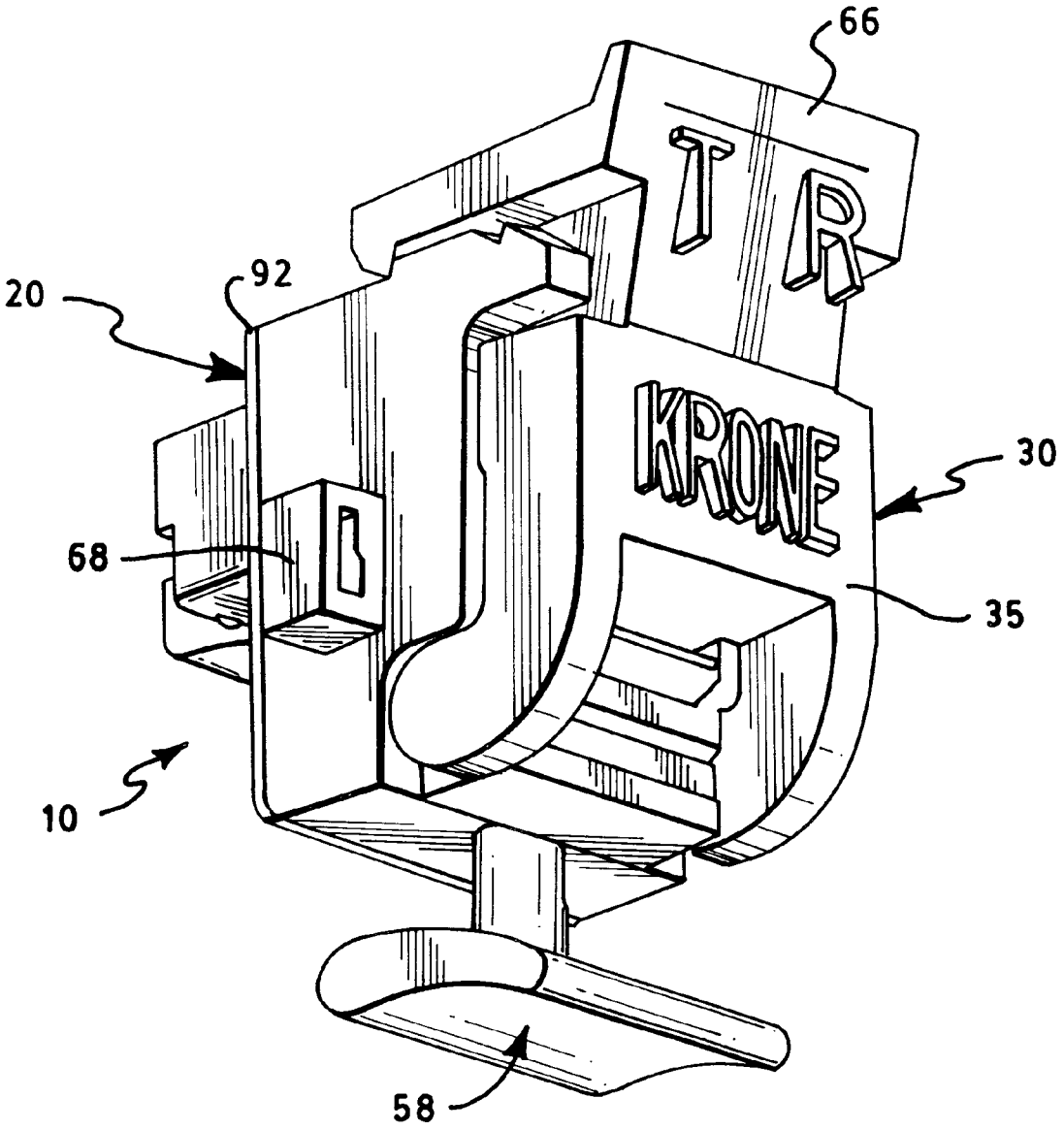
FIG. 2 is a bottom left front perspective view of the device of FIG. 1.

Referring to the drawings in particular, the invention comprises an RJ style plug with wire termination feature, generally designated 10. The plug 10 includes a plug body 20 and a plurality of contacts 12, including a plug portion 14 with a plug contact surface 16. Each of the contacts 12 also includes an insulation displacement contact (IDC) portion 18 which defines a wire receiving slot 19 (FIG. 5).

Figure 3:
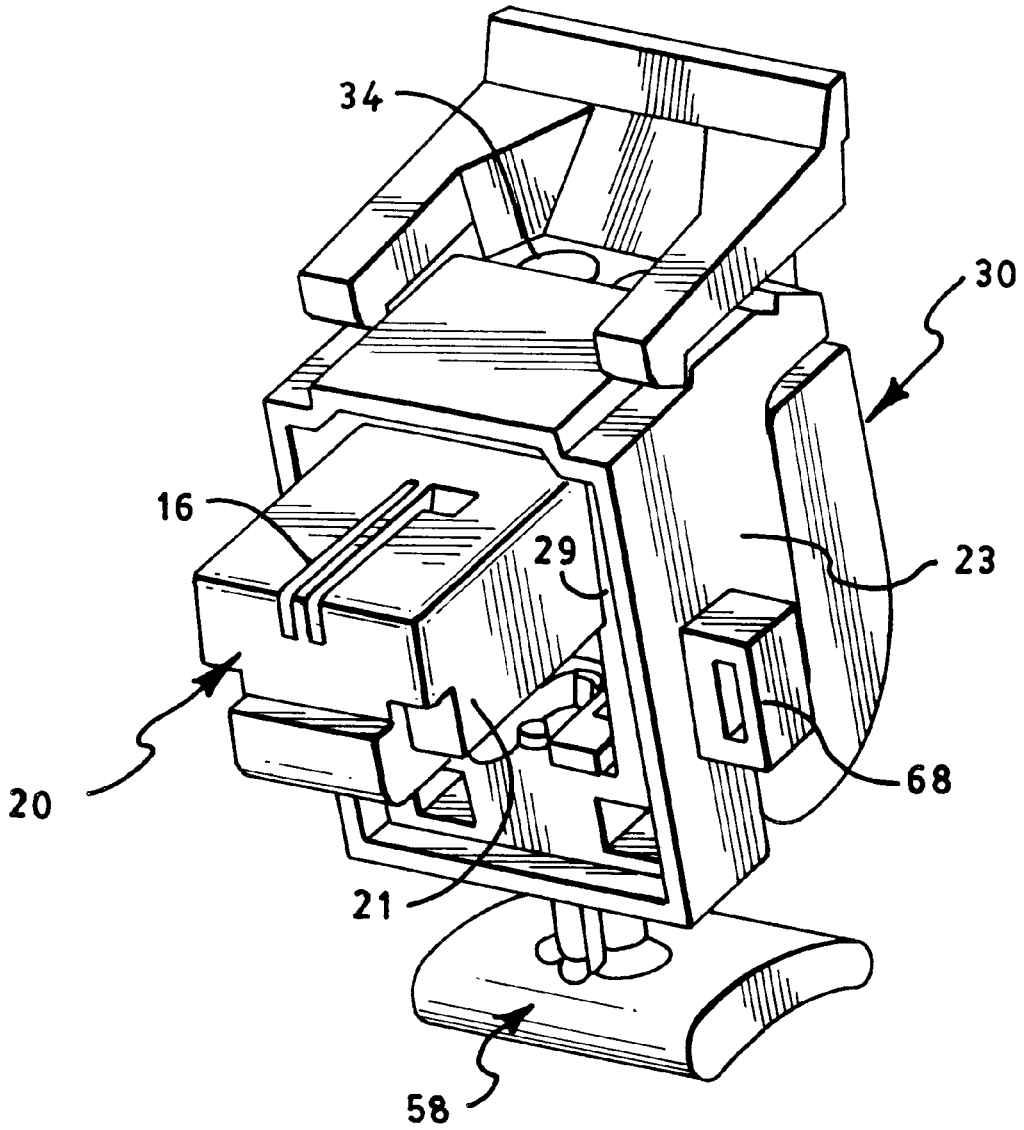
FIG. 3 is a top right rear perspective view of the device of FIG. 1.

The plug body 20 includes a plug profile shaped portion 21 as well as a rear housing portion 23. The plug profile portion 21 includes grooves or channels 25 for receiving plug portion 14 of contacts 12. The rear housing portion 23 has a surface 29 (FIG. 3) surrounding the plug profile portion 21.

The plug rear body part or rear housing portion 23 includes an interface for a cover 30. The cover 30 includes cover latch elements 32 as well as a cover hinge structure or cover hinge pin 38 (see FIG. 6). The hinge structure includes a first pivot part associated with the plug body 20 and second hinge part associated with the cover part 30. In the preferred embodiment the plug body 20 includes a receiving element described below for receiving the hinge pin or pivot member 38.

Figure 5:
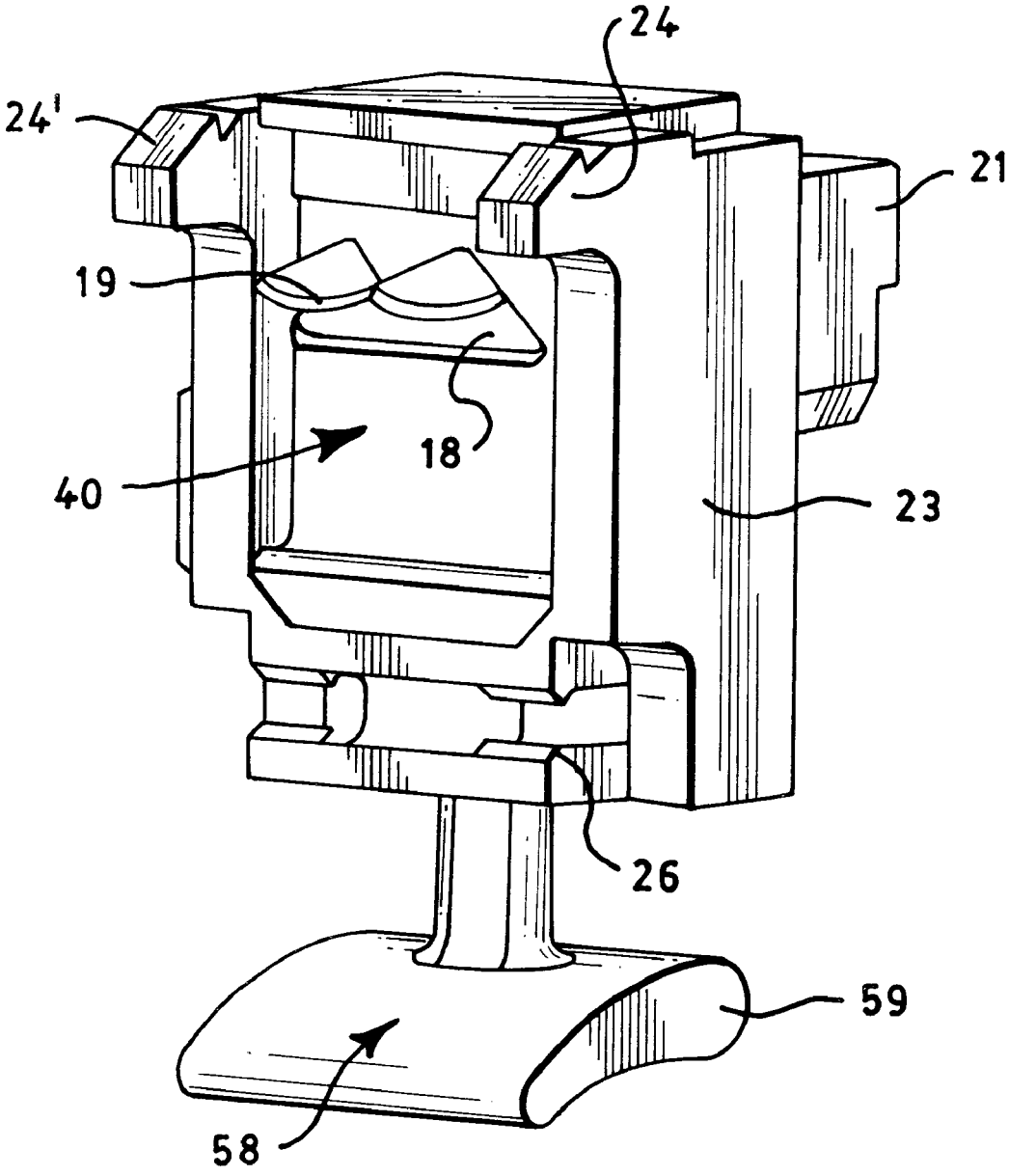
FIG. 5 is a bottom right rear perspective view showing the device of FIG. 1 with the cover removed.

FIG. 5 shows the plug body 20 with the cover 30 removed. In this position you can see the exposed IDC parts 18. Latch receiving parts 24 are also clearly visible in FIG. 5. These latch receiving parts 24 are shaped with an overhang or cantilever to provide a somewhat resilient structure and they include snap lock guiding surfaces 24'. The cover interface of rear body part 23 also includes a hinge pin receiving structure 26.

Figure 6:
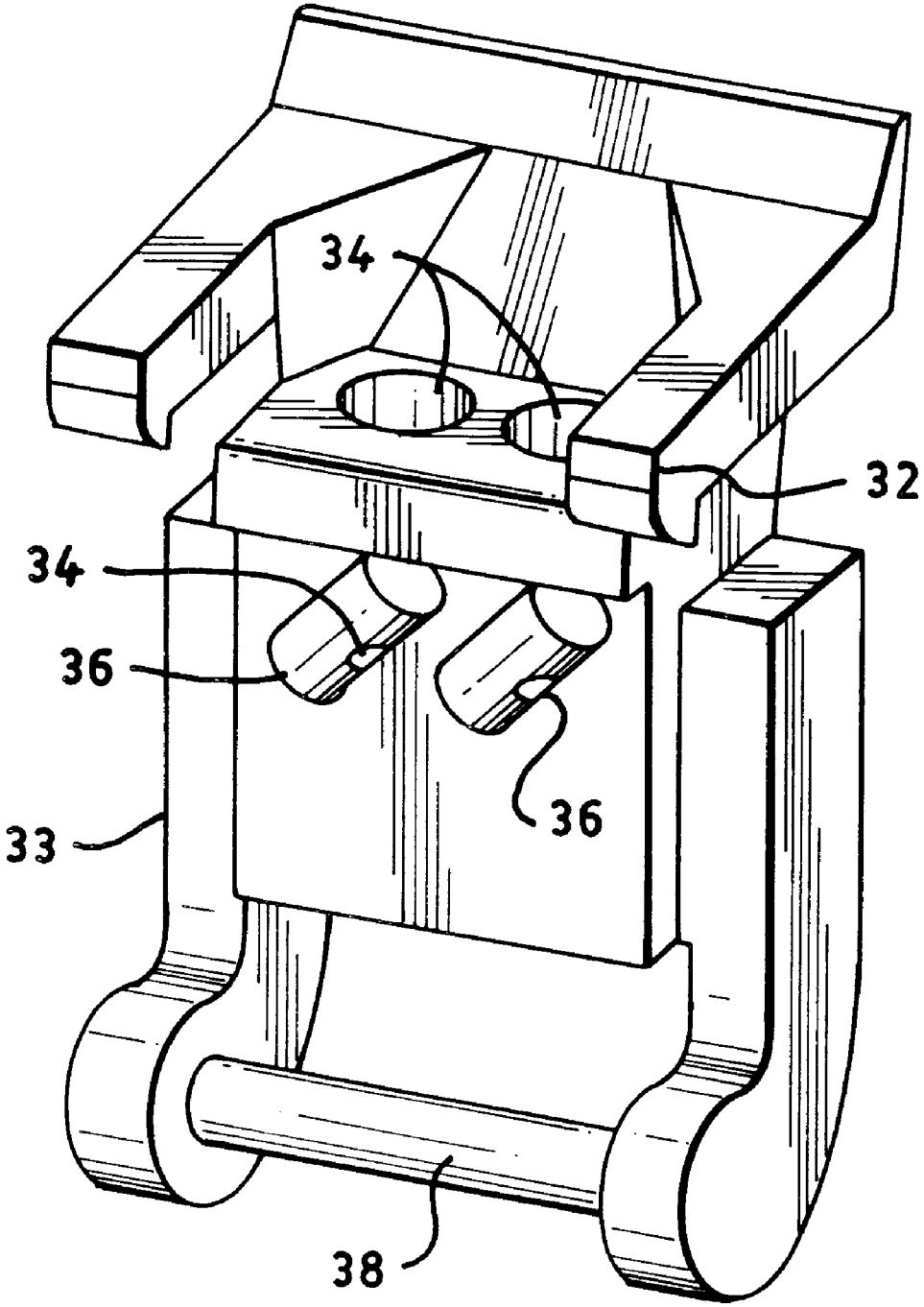
FIG. 6 is a perspective view showing an inside of the cover detached from the plug body.

The cover 30 includes cover or attaching body latch elements 32 as shown in FIG. 6. These latch elements 32 cooperate with the surface formed by the latch receiving parts 24. The cover has bores 34 with wire receiving openings. These bores 34 extend into the cover 30. The bores 34 are sized so as to be larger than a diameter of the wire to be received. Multiple wires can be received in each bore as well as a gel sealant. The wire may be for example an insulated wire as used in the telecommunications industry. The cover 30 also includes two slots which extend from an inside face 33 toward the front surface 35. The slots 36 are big enough to receive at least a portion of IDC part 18. The slots 36 extend away from the inside surface 33 at least a distance such as to intersect the bores 34. With this construction, wires which extend into the bores 34, e.g., to the bottom surface of the bore, which is downwardly of the slots 36, may be terminated as the IDC portions 18 of each contact 12 extend into the slots 36.

FIG. 5 also shows the contact assembly 40 which is inserted into a contact receiving space of the rear body 23 of plug body 20.

Figure 8A:
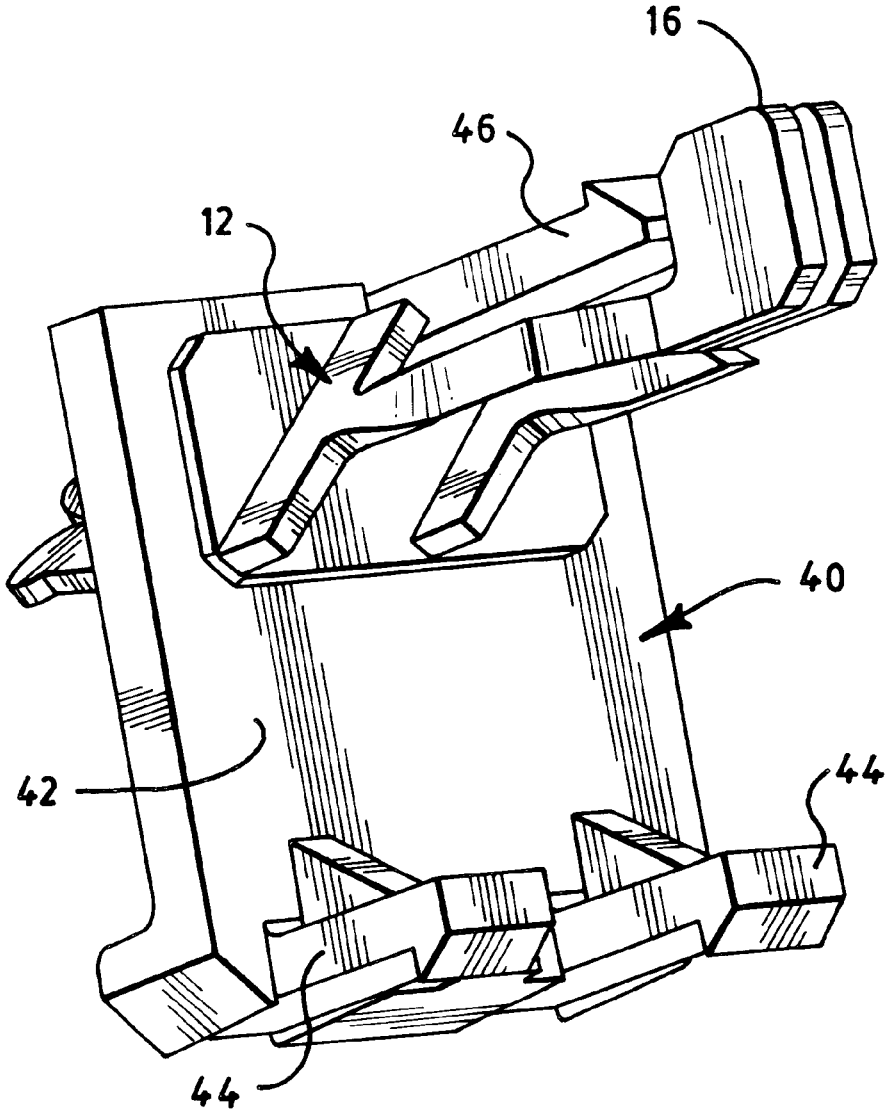
FIG. 8A is a perspective view of the front of the IDC assembly.
Figure 8B:
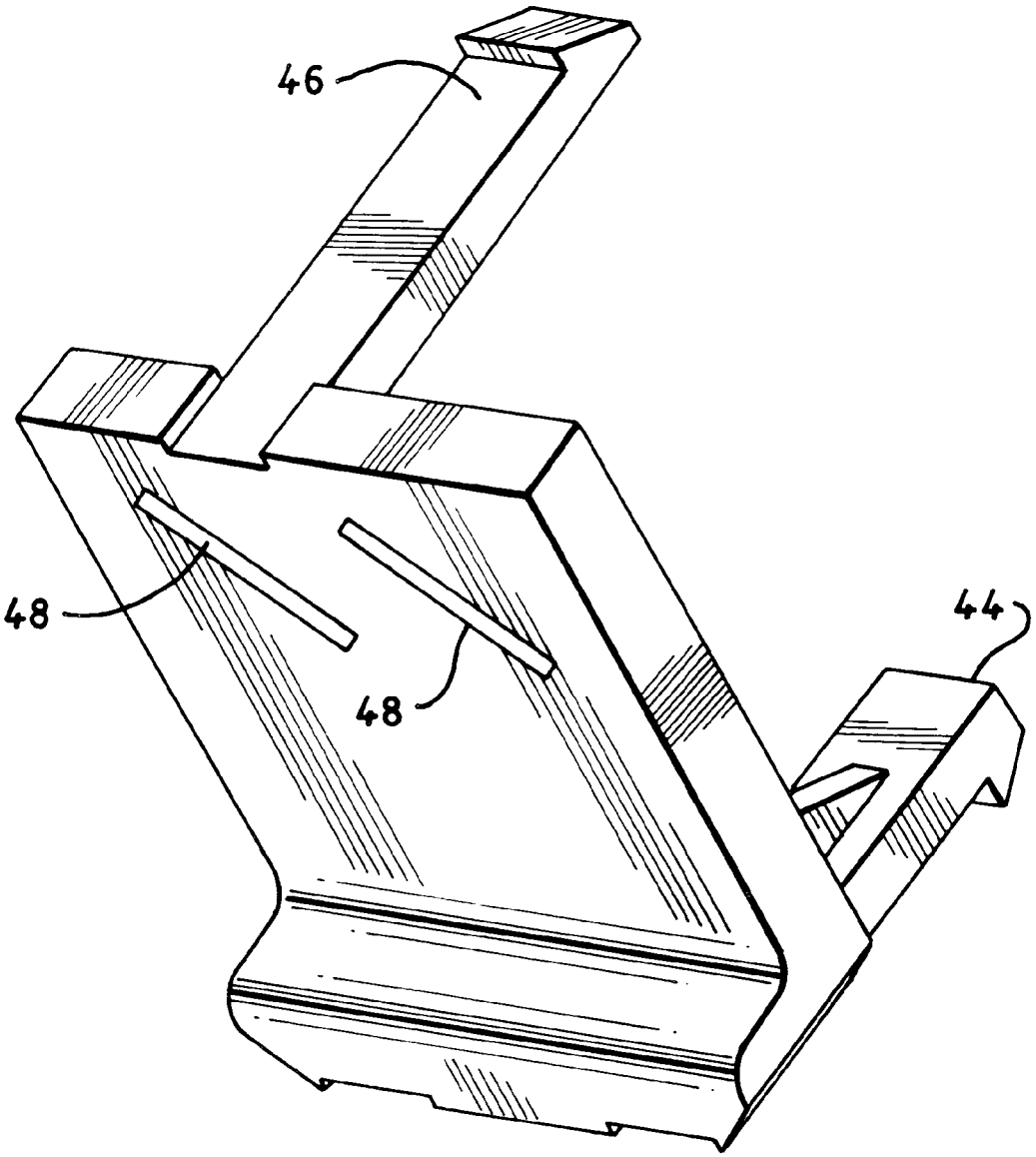
FIG. 8B is a perspective view of the rear of the IDC assembly with the contacts removed.

FIG. 8*a* shows the contact assembly 40 which includes a plastic molded element 42 with lower latch elements 44 and an upper latch element 46. As can be seen in FIG. 8*b*, the plastic element 42 has contact receiving slots 48 which receives contacts 12 and holds them in position. The contacts are constrained between the plastic element 42 and plug body. The contact has an element 15 which is trapped when 42 is snapped in place. These constraining parts 15 hold the IDCs in place on the plastic element 42.

Figure 4:
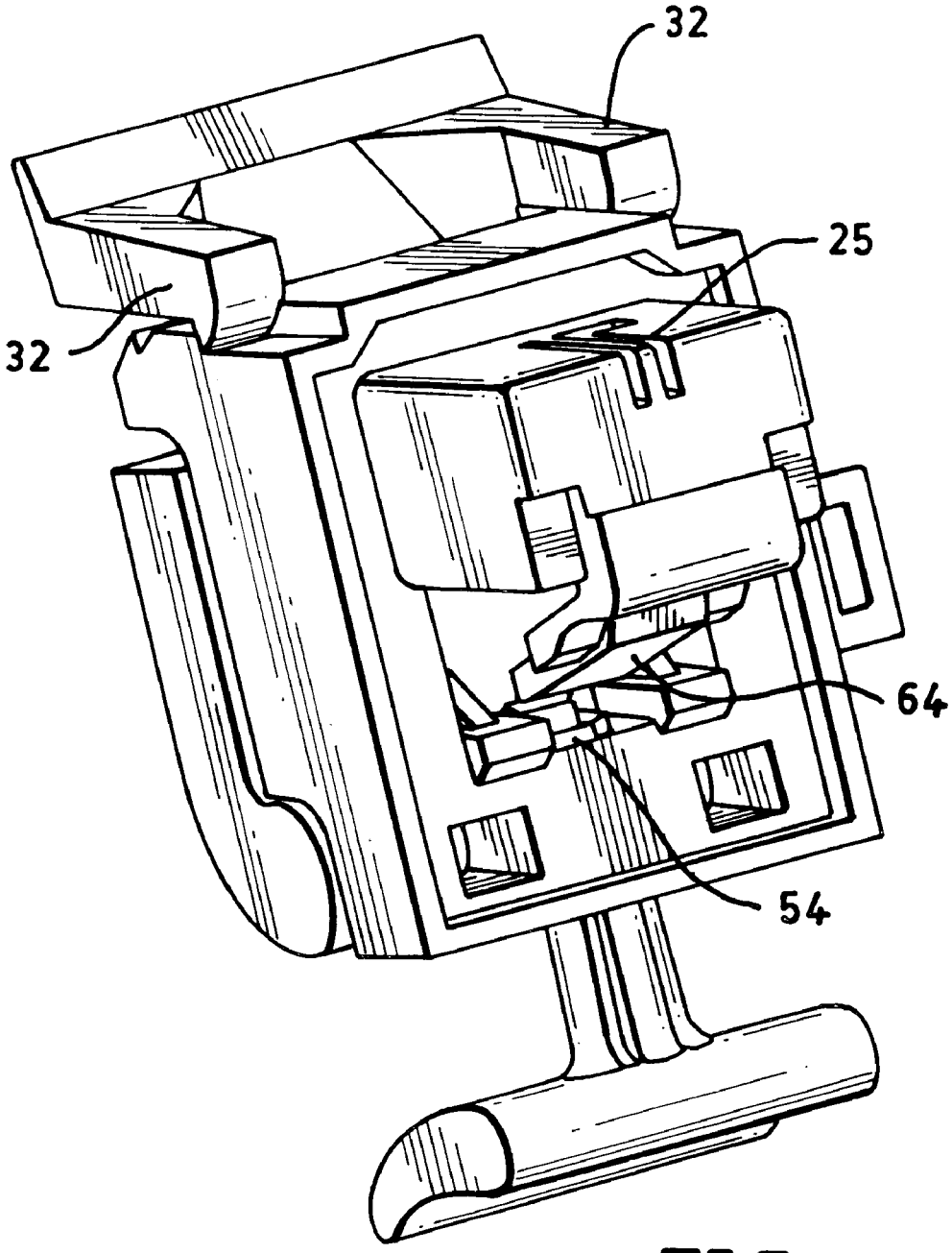
FIG. 4 it is a bottom right rear perspective view of the device of FIG. 1.
Figure 7:
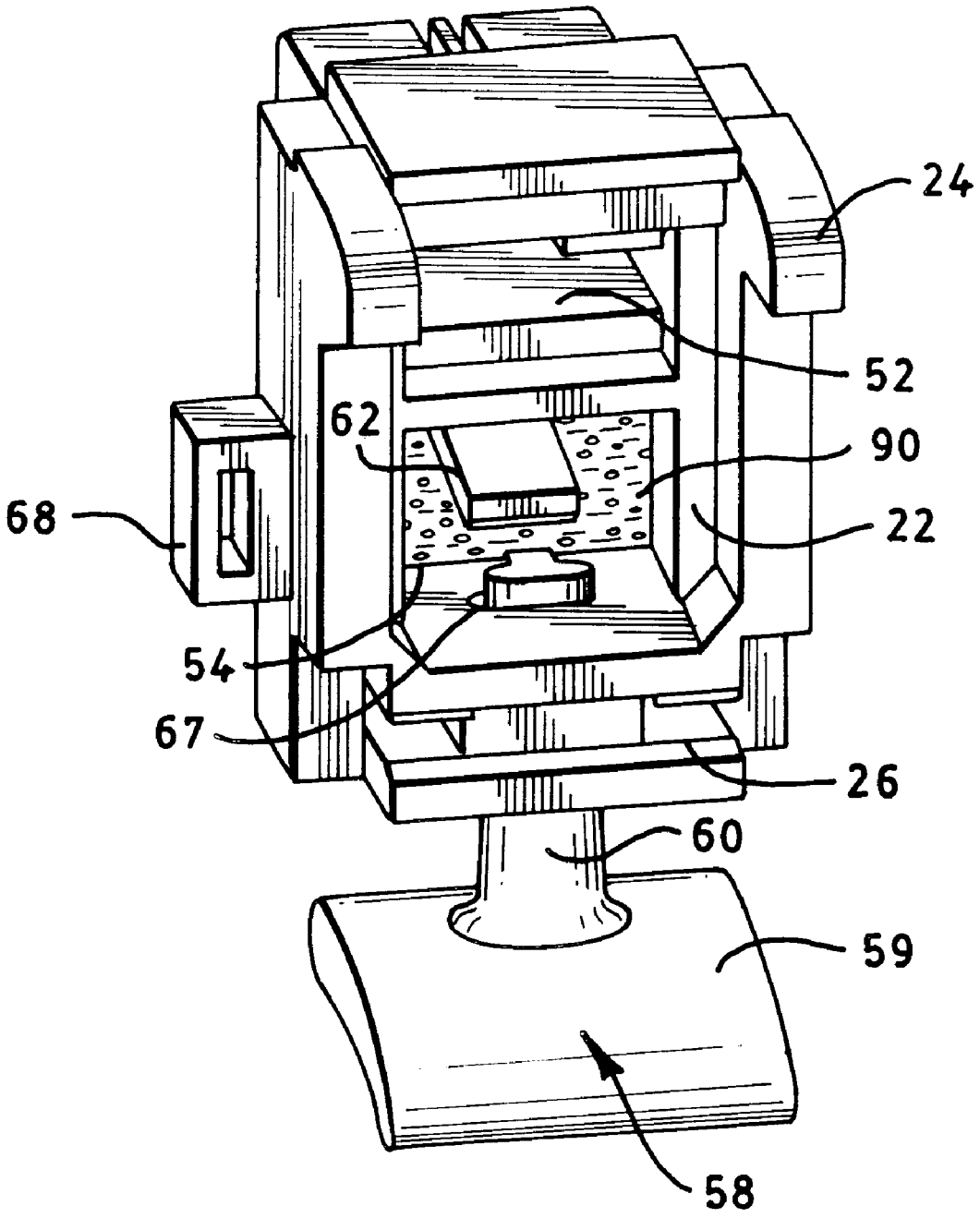
FIG. 7 is a perspective view showing the plug body with an insulation displacement contact (IDC) assembly removed.

FIG. 7 shows the plug body 20 with the contact assembly 40 removed. This shows the upper latch receiving space 52 for receiving the upper latch and the lower inside surface of the contact receiving space 22 which forms a lower latch receiving edge 54 for receiving the lower latch elements 44. FIG. 4 shows how the lower latch receiving edge 54 engages the lower latch elements 44. Within the contact receiving space 22 there is also provided a plug lock actuator lever 62 which is connected to a plug lock catch 64 (see FIG. 4). By moving the plug lock actuator lever 62 the plug lock catch 64 is moved. This allows the plug to be latched in the manner of known RJ style plugs. The plug lock actuator lever 62 is preferably actuated by plug lock actuator 58 which includes a post or rod 60. The plug lock actuator 58 is preferably a plastic molded part and is inserted into an opening 67 in the rear body part 23. Opening 67 can be gel filled for sealing. This way the post 60 extends through the rear body part 23 into the contact receiving space 22 and passes between the two contacts when the contact assembly is in its inserted position, within the contact receiving space 22, with the upper and lower latch elements 46 and 44 respectively engaged. The top surface of post 60 engages the plug lock actuator lever 62 such that moving the lever 59 allows the plug to be connected and disconnected from an RJ style socket. This construction frees the area at the profile portion so that a gasket can be used to seal region 29 and a surface surrounding the socket.

Figure 9A:
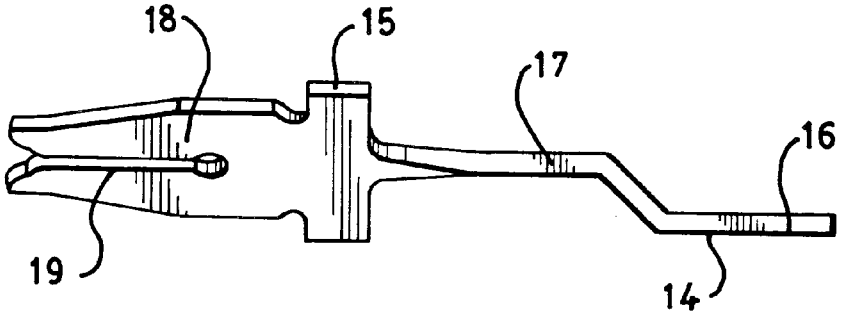
FIG. 9A is a top perspective view of an integrated IDC and RJ contact.

FIGS. 9*a*, 9*b*, 10*a*, 10*b* show the contact 12. As can be seen in FIG. 9*a*, one contact includes a plug portion 14 a plug contact surface 16 and an IDC 18 that defines an DC slot 19. The position of the surface 16 and the slot 19 are selected based on the desired end position of the contact surfaces 16 in the plug 20 and based on the contact, the contact receiving space 22 as well as the final position of the contact openings 36 and the position of the bores 34 relative to the cover 30. According to an advantageous feature of the invention, the IDC parts 14 are positioned relative to the remainder of the contacts 12 such that the plane of the IDC is angled (preferable a 45 degree angle) relative to the wire receiving direction defined by the contact openings 36. This 45 degree orientation can be appreciated from considering FIG. 8*b* wherein the slots 48 define the position of the IDCs 18. This can also be appreciated by considering FIG. 6 wherein the openings 36 are at an angle relative to the direction of the bores 34. The plane of the contact provided according to the invention is at an angle with regard to the direction of a wire to be terminated.

Figure 9B:
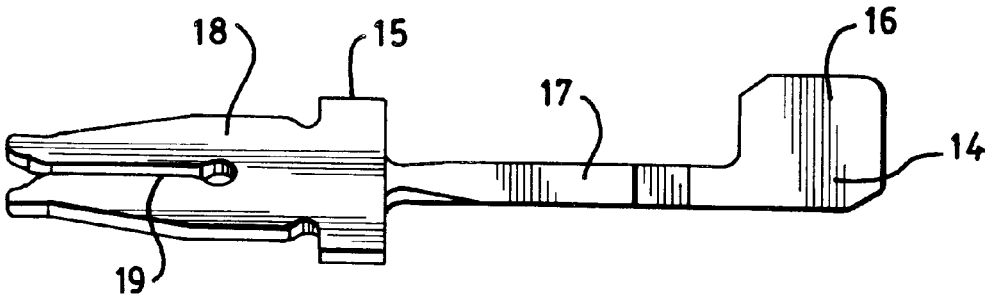
FIG. 9B is a side perspective view of the contact of FIG. 9A.

FIG. 9*b* shows a side view of the same contact as in FIG. 9*a*. The 45 degree position of the IDC 18 can be appreciated by comparing FIG. 9*a* to FIG. 9*b*.

Figure 10A:
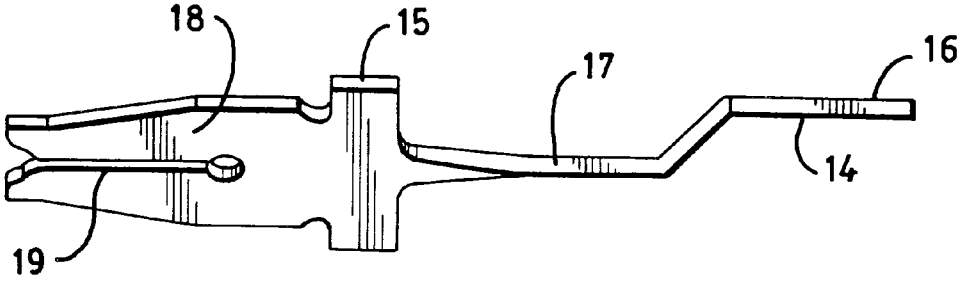
FIG. 10A is a top perspective view of another contact.
Figure 10B:
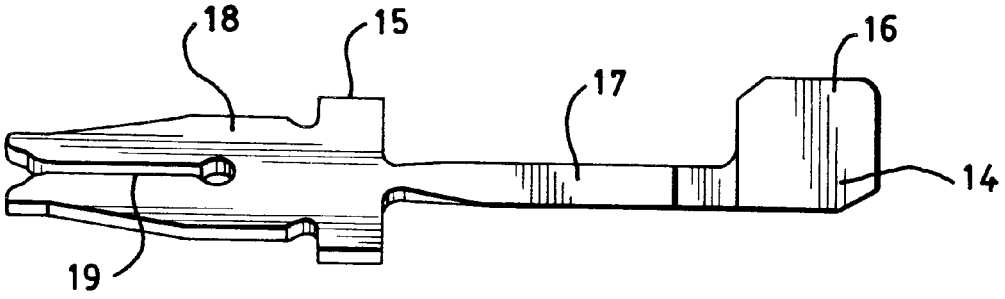
FIG. 10B is a side perspective view of the contact of FIG. 10A.

FIG. 10*a* and FIG. 10*b* show a similar contact 12 again with an IDC 18 and a plug portion 14. The IDC 18 again forms a slot 19 and the plug portion 14 has a plug contact surface 16.

The invention can provide more than two contacts 12. For example, the plug contour part 21 may be provided with a number of grooves 25, such as eight grooves 25 and corresponding internal slots corresponding to the typical maximum number of contacts used in an RJ style plug. With such further contacts, it may be important to provide the contact surface 16 and the connection to the IDC 18 in a particular manner for each contact. The shaping may be made to avoid or add capacitance/inductance in order to avoid or reduce overall cross-talk. The physical space limitations may require any number of shapes in the connection region 17 which connects the IDC 18 to the contact part 14. In the preferred embodiment, only two contacts are provided for a single transmission line to be established with the plug. In this case, the connection portion 17 positions the IDC elements 18 such that they are at the 45 degree angle as shown and the contact surface 16 is disposed based on a bent portion for positioning it in the slots 25 as shown. Obviously, other configurations are possible. For example, instead of using the two center closely spaced contacts, other contact locations (e.g., any of the eight standardized contact locations for an RJ style plug) may be used.

Figure 11:
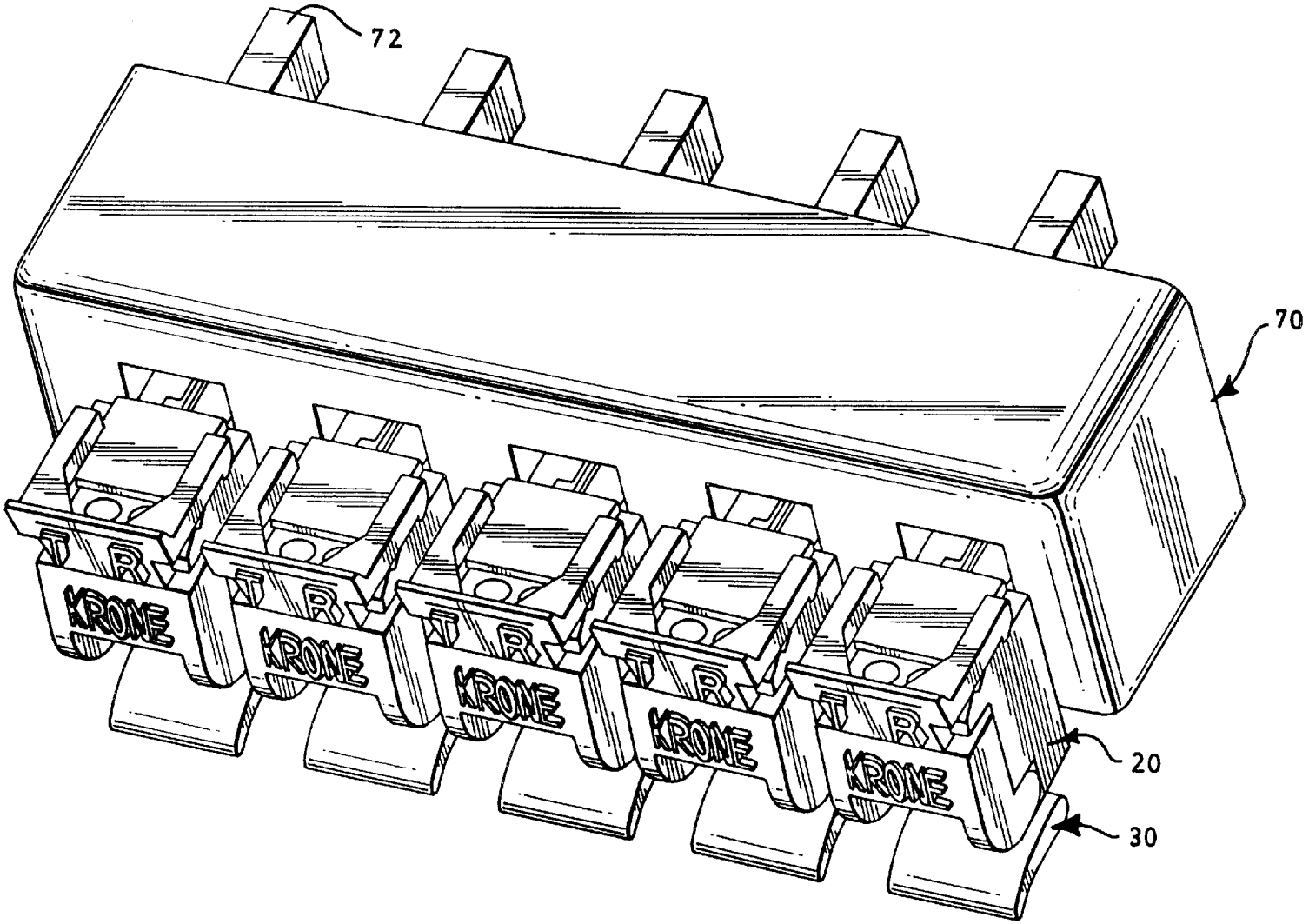
FIG. 11 is a top right front perspective view showing five plug assemblies connected to a five socket (jack) module (socket assembly)
Figure 12:
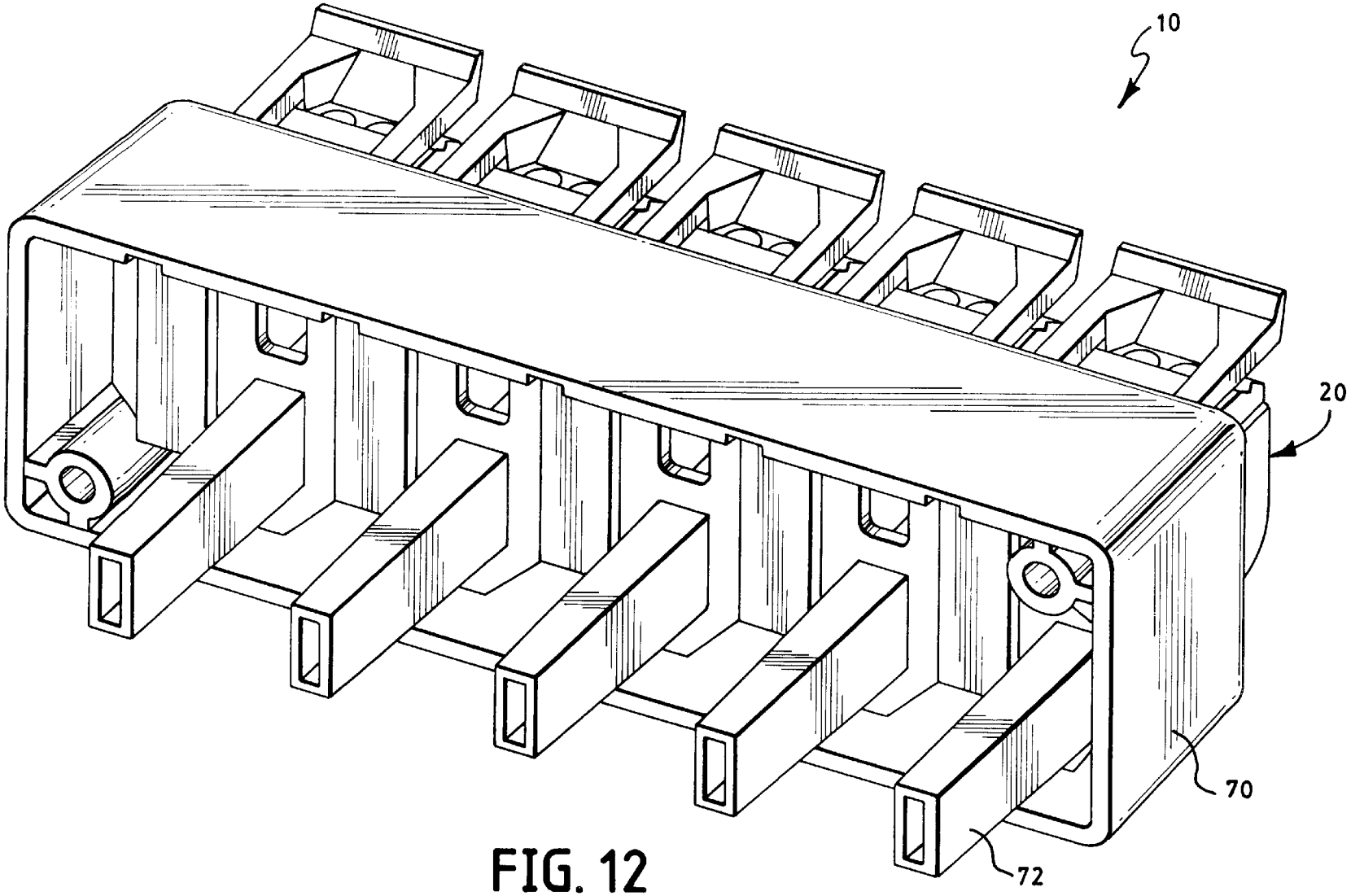
FIG. 12 is a left top rear perspective view showing the assemblies and socket module of FIG. 11.
Figure 13:
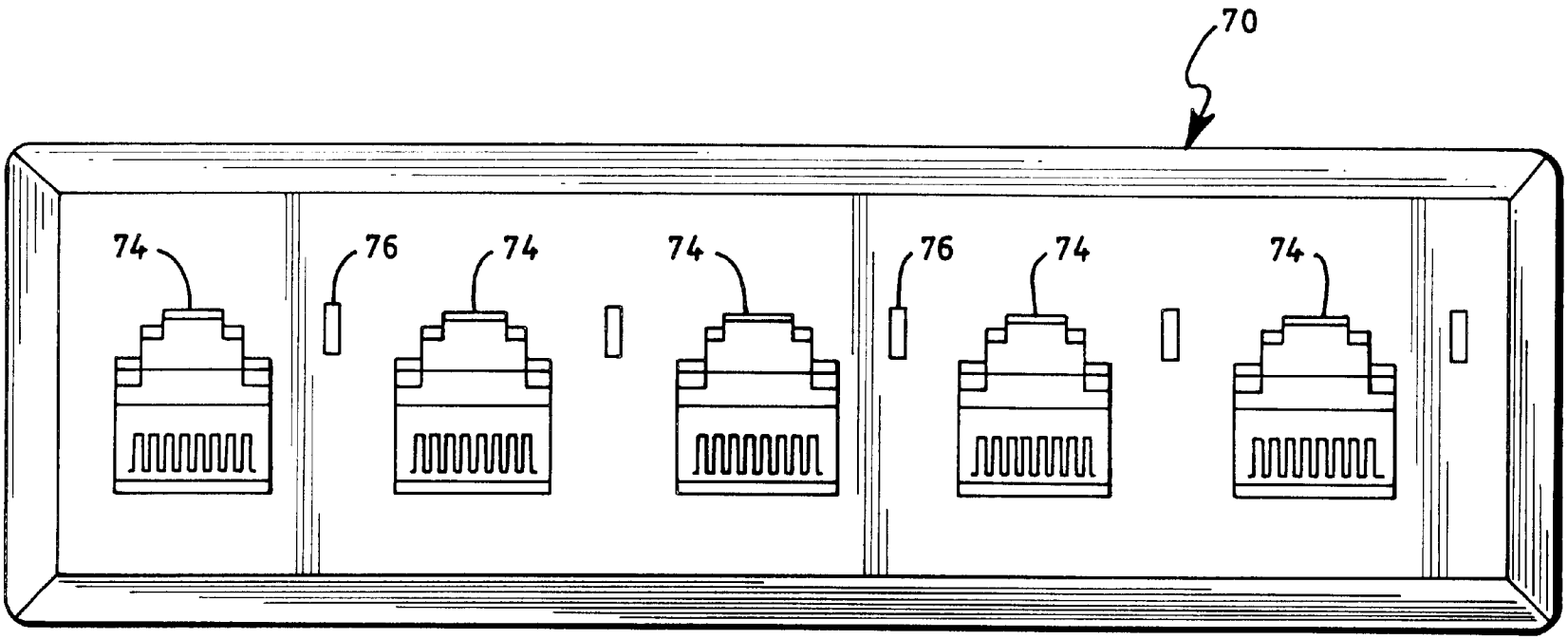
FIG. 13 is a front view of the socket assembly.

FIG. 11 shows a plurality of RJ style plugs (with termination feature) 10 connected to a socket assembly 70. The socket assembly 70 provides five sockets 74 as can be seen in FIG. 13. The assembly provides the sockets which have from two to eight contacts. Additionally, a retainer sleeve is also provided as part of the socket assembly 70. The retainer sleeve 72 holds a retainer element or retainer strap 78 which can be extended out of the retainer opening 76 and connected to the retaining part 68 of each plug and termination element 10. The provision of the socket assembly 70 with a sleeve 72 allows the retaining element to be stored in the sleeve or retracted when the plug is in its connected position. However, the plug can also be disconnected. The plug can hang with the retaining element extending outwardly of the retaining sleeve 72 from the retaining opening 76 allowing the plug to be held near to the socket assembly 70 but in a non-connected state. This facilitates testing.

Figure 14A:
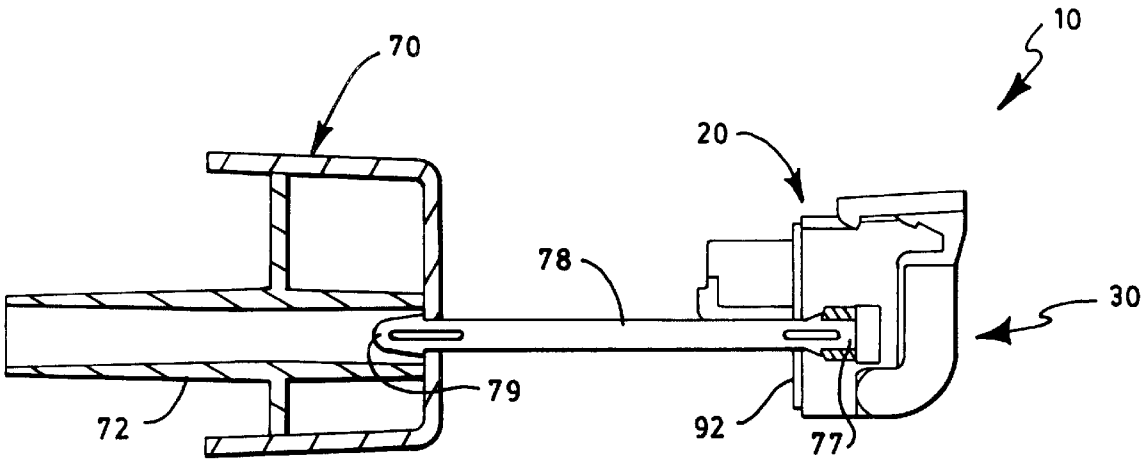
FIG. 14A is a cross-sectional view of the socket assembly with plug in a non-connected position with connected retaining strap.
Figure 14B:
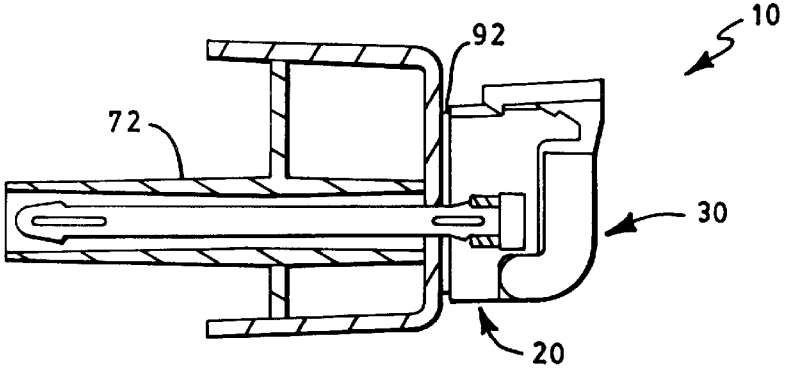
FIG. 14B is a cross-sectional view showing the socket assembly with plug in a connected position, with connecting contact strap.

FIG. 14A shows the strap 78 in an extended position. FIG. 14B shows the strap 78 in a retracted position with the plug 10 connected. The back of the jack or socket assembly 70 is potted or otherwise environmentally sealed without restricting the movement of the retaining strap. With the plug arrangement 10 connected at ends 77 of the strap 78, the movement of the plug arrangement 10 is limited by the connection at end 79 (see FIG. 14B).

The RJ style plug with termination feature 10 is assembled based on a plug body 20 with rear housing part 23. First the IDC elements 12 are positioned in the contact support 42 to form a contact assembly 40 as shown in FIG. 8*a*. Next the plug lock actuator 58 is provided with its post 60 inserted into opening 67 so as to be able to actuate plug lock actuator lever 62. Prior to inserting the contact assembly 40 gel 90 may be disposed in the contact receiving space 22. Such sealing gels are especially useful to avoid any corrosive problems and to avoid any moisture infiltration problems. Also, the design allows for a foam gasket 92 which seals the plug and jack interface (at 29).

The contact assembly 40 is then inserted such that the plug portion 14 extends into the plug body 20, specifically into the plug contour part 21 with the plug contact surface 16 being accessible through grooves 25. As the housing assembly 40 is inserted into the space 22 the lower latch elements 44 are snapped into engagement with the lower latch receiving edge 54. In a similar manner the upper latch element 46 is inserted into the upper latch receiving space 52 and engages a latching surface to retain the assembly 40 in position. In this position within the contact receiving space 22 the post 60 can extend upwardly between contacts for engaging the plug lock actuator lever 62. With the contact assembly disposed in the plug body 20 in the rear plug body portion 23 and with the plug lock actuator 58 disposed in its position for use, an arrangement is provided which is ready to receive a cover 30. The cover 30 allows a toolless termination of wires. For this, the cover hinge pin 38 is inserted in the hinge pin receiving structure 26. The plug body 20 may be plastic formed by an injection molding process so as to provide some resiliency to the two sides that form the hinge pin receiving structure 26. This provides a snap action as the cover hinge pin 38 is inserted in the hinge pin receiving structure 26. Advantageously, the space around the IDC parts 18 may be filled with gel so as to avoid moisture infiltration problems and to provide a sealed structure. The bores 34 and slots 36 may be filled with sealing gel. As the cover is closed, the IDC parts 18 pass into the slots 36 and the latch receiving parts 24 engage the cover latch elements 32.

In operation, the cover is pivoted by disconnecting the cover latch elements 32 from the latch receiving parts 24. This can be done advantageously based on the shape 33 of the pressing part 66. By pulling backwardly on the part 33 disengagement of latch elements 32 is facilitated and the cover 30 can be pivoted backwardly. After pivoting the cover a certain distance wires such as insulated wires are disposed in the bores 34, inserted to the full depth of the bore. Pressure is applied to the pressing surface 66 and the cover is returned to its latched position with latching elements 32 engaging latch receiving parts 24. As the cover is pivoted the IDC contacts 18 pass into the slots 36 and terminate the wires which are inserted in the bores 34. As noted above, the direction of the wires in bores 34 is approximately 45 degrees with respect to a plane of the IDC elements 18.

With wires terminated to the RJ style plug (with wire termination feature) 10 the plug may be inserted into a socket such as one of the sockets of the socket assembly 70. Further, a retaining element may be connected to retaining part 68. The retaining element 78 extends into the retainer sleeve 72 via retainer opening 76. When the plug is removed, if the retaining element 78 is maintained connected to retaining part 68 the plug may be maintained connected to the assembly 70 even though the plug is not in a mated position in the socket.

In practice, preferably a unit with one or more socket assemblies 70 is provided wherein a plurality of non-terminated plugs 10 are provided connected via a retaining element 78 to the socket assembly 70. A technician is then able to selectively terminate wires to the plugs and a plug is always maintained associated with the socket. The retaining part 78 facilitates the operation by keeping an association between a socket and a plug 10 and avoiding the loss or disassociation of a plug from the socket. Additionally, easy test access is provided, wherein the plug is simply removed for testing, with the plug maintained in close proximity by strap 78. A plug/socket test element may be disposed between the plug and jack (socket assembly 70) in the position of plug 10 shown in FIG. 14A.

While specific embodiments of the invention have been shown and described in detail to illustrate the application of the principles of the invention, it will be understood that the invention may be embodied otherwise without departing from such principles.

What is claimed is:

1. An RJ style device, comprising:

plug body with an RJ style plug profile portion defining a contact region and with a plug body contact termination space;

contacts supported by said body, said contacts each including a plug portion with a plug contact surface extending into said RJ style plug body to said contact region and an insulation displacement contact (IDC) portion with a wire receiving contact slot; and a toolless wire termination means pivotably connected to said plug body, said toolless wire termination means for positioning the insulated conductive wires in a termination position, for bringing the conductive wires respectively into said insulation displacement contact portion of the respective contacts with the wires in said termination position and for terminating the conductive wires respectively to the insulation displacement contact portion of the respective contacts and enclosing said contact termination space.

2. The device according to claim 1, wherein each of said contacts is a single integral metal piece including one end with said IDC portion and an opposite end with said plug contact surface.

3. The device according to claim 1, wherein said plug body supports each of said contacts with said insulation displacement contact portion being at an angle with respect to the position of the insulated conductive wires in said termination position.

4. The device according to claim 1, wherein said toolless wire termination means includes an attaching body connected to said plug body, said attaching body and said plug body including connection surfaces for connecting said attaching body to said plug body whereby said attaching body is a cover of a contact space of said plug body, said attaching body including a wire positioning surface for positioning a wire in said contact slot for terminating the wire to the contact upon closing the cover to define a toolless wire termination mechanism.

5. The device according to claim 1, further comprising:

a socket assembly; and a strap connecting said plug body to said socket assembly, whereby said plug body may be mated with a socket and may be maintained connected to said socket assembly in a non mated state via said strap.

6. The device according to claim 1, further comprising: a socket assembly; and a gasket disposed at a surface of said plug body to define a sealed connection between said plug body and said socket assembly when said plug is inserted in a socket of said socket assembly.

7. The device according to claim 1, wherein said toolless wire termination means includes an attaching body, said attaching body and said plug body including connection surfaces for connecting said attaching body to said plug body, said attaching body including wire positioning surfaces for positioning a wire in said contact slot whereby said wires are held in a position relative to said attaching body for terminating the conductive wires respectively to the insulation displacement contact portion of the respective contacts and said connection surfaces attach said attaching body to said plug body to bring said wires into respectively into said insulation displacement contact portion of the respective contacts.

8. The device according to claim 7, wherein said plug body is a plastic molded part and said attaching piece is a plastic molded part.

9. The device according to claim 7, wherein said connection surfaces include a pivot surface associated with one of said attaching body and said plug body and a pivot receiving surface associated with the other of said attaching body and said plug body.

10. The device according to claim 9, wherein said connection surfaces include a snap element associated with one of said attaching body and said plug body and a snap receiving surface associated with the other of said attaching body and said plug body.

11. The device according to claim 7, wherein said wire positioning surfaces include surfaces defining a bore for receiving a wire end and an opening extending from a plug side surface of said attaching body to said bore, said opening being sized to receive an end of said insulation displacement contact portion when said attaching body is connected to said plug body.

12. The device according to claim 11, wherein said attaching body and said plug body cooperate to define a gel sealing space including said contact termination space whereby a gel substance may be disposed therein.

13. The device according to claim 12, further comprising a latch element associated with a plug end of said plug body and a latch activating element connected to said plug body, said latch element extending into said contact termination space and said latch activating element extending into said contact termination space.

14. A data/telecommunications application connection process, comprising the steps of:

providing a plug body with a plug profile portion defining a contact region with contact channels and having a gel sealing space;

providing a plurality of contacts, each with a plug contact portion with a plug contact surface and an insulation displacement contact portion with a wire receiving contact slot;

positioning the contacts in the plug body with each contact supported by said plug body and with each plug contact portion in a corresponding contact channel;

providing an attaching body, said attaching body and said plug body including connection surfaces;

connecting said attaching body to said plug body to provide a cover, said attaching body including a wire positioning surface, said cover being between an open and closed position;

positioning a wire with said wire positioning surface, with said cover in an open position;

disposing a gel in said gel sealing space;

closing said cover with said wire positioned to move said wire into a wire receiving contact slot of one of said contacts, terminating the wire to the contact.

15. The process according to claim 14, wherein said wire positioning surfaces include surfaces defining a bore for receiving a wire end and an opening extending from a plug side surface of said attaching body to said bore, said opening being sized to receive an end of said insulation displacement contact portion when said cover is closed.

16. The process according to claim 14, wherein said connection surfaces include a pivot surface associated with one of said attaching body and said plug body and a pivot receiving surface associated with the other of said attaching body and said plug body, wherein said connection surfaces include a snap element associated with one of said attaching body and said plug body and a snap receiving surface associated with the other of said attaching body and said plug body.

17. The process according to claim 14, further comprising:

providing a socket assembly;

providing a strap;

connecting said plug body to said strap and connecting said socket assembly to said strap;

maintaining said plug connected to said strap and moving said plug into a socket and withdrawing the plug from the socket while maintaining the strap connection between said plug and said socket assembly; and placing a gasket around said plug profile portion between said plug body and said socket assembly.

18. A data/telecommunications application connection device, comprising:

a plug body with a plug profile portion defining a contact region with contact channels said plug body having a contact termination space;

a plurality of contacts, each contact having a plug contact portion with a plug contact surface and an insulation displacement contact portion with a wire receiving contact slot, said contacts being supported by said plug body with each plug contact portion in a corresponding one of said contact channels;

a toolless wire termination mechanism including a cover body connectable to said plug body for closing said contact termination space, said cover body including wire positioning bores, each of said bores extending from an outer surface of said cover body to a respective bore stop face, each of said bores positioning the insulated conductive wires in a termination position, and said cover body including an opening for each bore, each said opening extending from a contact termination space side surface of said cover to a respective associated one of said bores at a location between said bore stop face and said outer surface of said cover body, said opening being sized to receive an end of said insulation displacement contact portion when said cover is closed, whereby closing the cover moves the conductive wires respectively into said insulation displacement contact portion of the respective contacts with the wires in said termination position and for terminating the conductive wires respectively to the insulation displacement contact portion of the respective contacts.

19. The device of claim 18, further comprising:

a hinge pivotably connecting said cover body to said plug body at a pivot end of said cover body, said cover body and said plug body including a snap mechanism at an end of said cover body opposite said pivot end for fixing a position of said cover body relative to said plug body.

20. The device of claim 19, wherein each contact is mounted in said plug part with said insulation displacement contact portion with wire receiving contact slot defining a plane which is at an angle other than 90° relative to the wire in said termination position.

* * * * *